United States Patent [19]

Rasquin et al.

[11] 3,988,526

[45] Oct. 26, 1976

[54] INTERNALLY COOLED HIGH-VOLTAGE HIGH-ENERGY CABLE

[75] Inventors: Werner Rasquin; Klaus Sütterlin, both of Cologne, Germany

[73] Assignee: Felten & Guilleaume Kabelwerke AG, Cologne, Germany

[22] Filed: Apr. 4, 1974

[21] Appl. No.: 457,778

[30] Foreign Application Priority Data

Apr. 5, 1973 Germany ..... 2317013

[52] U.S. Cl. ..... 174/15 C; 174/128 R; 174/130

[51] Int. Cl.[2] ..... H01B 7/34

[58] Field of Search ..... 174/15 C, 15 R, 16 B, 174/25, 110 A, 120 FP, 102 SC, 130, 126 R, 128

[56] References Cited

UNITED STATES PATENTS

| | | | |
|---|---|---|---|
| 873,216 | 12/1907 | Davis | 174/15 C |
| 2,969,415 | 1/1961 | Hartill et al. | 174/19 |
| 3,509,266 | 4/1970 | Endacott | 174/15 C |
| 3,666,879 | 5/1972 | Hirsch | 174/130 X |
| 3,780,206 | 12/1973 | Reynolds | 174/120 FP |

FOREIGN PATENTS OR APPLICATIONS

| | | | |
|---|---|---|---|
| 1,133,333 | 11/1968 | United Kingdom | 174/110 A |
| 622,506 | 6/1971 | Canada | 174/15 C |
| 1,940,148 | 2/1971 | Germany | 174/15 C |
| 6,709,221 | 1/1969 | Netherlands | 174/102 SC |

OTHER PUBLICATIONS

Electric Times, *Advantages of 400KV Internally Oil--Cooled Cable*, vol. 158, No. 12, Sept. 17, 1970.

*Primary Examiner*—Arthur T. Grimley
*Attorney, Agent, or Firm*—Michael J. Striker

[57] ABSTRACT

A cable for transmitting high electric energies comprises an inner tubular member which is provided with a channel for conducting a cooling medium, cable jacket surrounding the tubular member with spacing, and insulation provided intermediate said tubular member and cable jacket. The tubular member is circumferentially complete so that no cooling medium can escape into the insulation and destroy the insulating properties thereof. The tubular member may itself serve as an electric conductor, or it may be surrounded by an electric conductor.

9 Claims, 2 Drawing Figures

INTERNALLY COOLED HIGH-VOLTAGE HIGH-ENERGY CABLE

BACKGROUND OF THE INVENTION

The present invention relates to an internally cooled cable for transmitting high electrical energies, and particularly to a cable comprising an electric conductor surrounding a circumferentially complete channel for conducting a cooling medium, an outer cable jacket surrounding the electric conductor and insulation intermediate the electric conductor and the cable jacket and separating one from the other.

There are already known internally cooled, particularly water cooled, high-energy cables, for instance from the German published patent application No. 1,960,546 or from the publication Draht Coburg 21 (1970) No. 4, entitled "Wassergekühltes Kabel für die CERN" (Water-cooled Cable for the CERN), pages 230 to 233. However, the cables disclosed in these publications are not suited for transmission of high electric energies in the region up to 2000 MVA. This can be easily established from considering the selected cable dimensions, such as the diameter of the electric conductor or from the diameter of the cooling channel.

Furthermore, it is known, for instance from the U.S. Pat. No. 3,509,266 to provide a high-voltage cable with a high energy-transmitting capacity, which includes an electric conductor which is sealed and which is provided with an internal channel through which a cooling medium, such as water, is conducted. However, the electric conductor of this cable is not circumferentially complete but rather provided with a fluid-impermeable layer on its outer surface in order to prevent the cooling medium from penetrating into the electric insulation. It is true that this patent discloses that the transmission capacity of a cable can be substantially increased by internally cooling the same; however, no information is provided about the dimensioning of such water-cooled high-voltage cable and particularly about the dimensions of the electric conductor so as to minimize the expenses connected with such a cable, which expenses include the expenses of manufacturing and installing the cable and the operating expenses of the cable.

SUMMARY OF THE INVENTION

It is an object of the present invention to provide a water-cooled high-voltage cable which avoids the disadvantages of the prior art.

It is another object of the present invention to provide a water-cooled cable which renders possible the transmission of high electric energies in the order of 2000 MVA.

It is yet another object of the present invention to provide an electric cable which is relatively inexpensive to produce and easy to install.

It is still another object of the present invention to provide a cable which minimizes the overall costs connected with providing and operating the cable regardless of the length and of the transmitted energy of the cable.

In pursuance of these objects and others which will become apparent hereafter, one feature of the present invention resides in the provision of a tubular member which defines a channel for a cooling medium such as water, a cable jacket surrounding the tubular member, and an electric insulation provided intermediate the tubular member and the cable jacket. In the currently preferred embodiment of the invention, the tubular member is surrounded by an electric conductor made of copper or aluminum. it is another feature of the present invention that, when the electric conductor is made of aluminum, the diameter of the channel provided in the tubular member is at least 60 mm, preferably equal to or exceeding 70 mm and, when the electric conductor is made of copper, then the inner diameter of the channel is at least 70 mm preferably equal to or exceeding 80 mm. When such dimensions of the channel are selected according to the invention, it is assured that the expenses connected with the production and the maintenance of the cable are minimized. In other words, the overall expenses, which are obtained by summarizing the cost of installing the cable on the one hand, and the cost of maintaining the cable and of electric losses occurring during the operation of the cable on the other hand are at their optimum, while any deviation from the above-mentioned values of the dimensions of the cable results either in an increase of the cost of installation or in an increase in the amount of losses and the cost of maintaining the cable with a disproportionate decrease of the other of these costs, so that the summation of the two costs results in a higher overall expense than that obtained when the dimensions are such as proposed by the present invention. According to the invention, the effect of the expense reduction with a simultaneous increase in the transmitted electric energy can be even more increased when the thickness of the wall of the electric conductor amounts to substantially 15 mm when aluminum is used for the electric conductor, resulting in a conducting cross-section of at least 3200 $mm^2$ while, when copper is used for the electric conductor, the wall thickness of the electric conductor amounts to substantially 12.5 mm and the conductive cross-section of the electric conductor amounts to at least 3000 $mm^2$.

In view of the fact that the high-voltage high-energy cable according to the invention has to retain the advantageous properties as the conventional cables, especially of the fact that the cable must be sufficiently flexible in order to permit its storage and transportation on reels or drums, without adversely effecting the cross-section of the electric conductor and the resistance of the electric conductor, to current flow therethrough, it is a further feature of the present invention to form the electric conductor as a spirally, helically or annularly corrugated metallic tubular member provided with the cooling channel therein and preventing escape of the cooling medium outside the electric conductor. As a result of the corrugation of the tubular electric conductor, the latter is sufficiently flexible and it satisfies all requirements for its flexibility without the cross-section thereof being adversely affected during the flexing of the cable. When it is desired to even more increase the energy to be transmitted by the cable according to the invention, it is necessary to improve the current-conducting properties of the cable, particularly to increase the amount of electric energy transmitted thereby. One of the possibilities of increasing this capacity of the electric conductor to transmit electric current resides in increasing the cross-section of the electric conductor. However, since it is impossible to increase the cross-section of the electric conductor ad infinitum especially when the electric conductor is formed as a tubular member, it is proposed in a currently preferred embodiment of the invention that the electric conductor of the high-voltage high-energy cable is formed by a smooth or a spirally, helically, or annularly corrugated metallic tubular member which surrounds and defines the channel therein, the tubular member being surrounded by a plurality of electric conductor elements or strands which are arranged about the tubular member in form of segments and/or in a plurality of layers, and which serve the purpose of conducting the electric current therethrough. When the cable is formed in the above-described manner, the following advantages are achieved: the cross-section of the electric conductor remains unchanged even when the cable is subjected to very high flexing stresses, the cross-sectional area of the electric conductor is relatively large while the skin effect is to a large degree avoided, the surface pressure in the region of contact with the electric insulation is significantly reduced, the electric conductor has a high coefficient of filling or space utilization, and it has a relatively large outer surface in contact with the electric insulation and, therefore, a good coefficient of thermal conduction outwardly of the electric conductor through the electric insulation.

Experience has shown that in a tubular conducting member, such as that provided according to the invention, it is undesirable to increase the thickness of the wall of such a tubular conducting member substantially above the equivalent conductor thickness of the material of the conductor. The thickness $\delta$ of the wall of the electric conductor may be calculated from the following equation:

$$\delta = \sqrt{\frac{\rho}{\mu \cdot f \cdot \pi}},$$

wherein $\rho$ is the specific electric resistance, f is the frequency of the alternating current, and $\mu$ is the permeability of the material of the conductor.

In view of the fact that the specific resistance of the electric conductor increases with the increasing temperature, it may be concluded from the above equation that the equivalent thickness of the conducting wall of the electric conductor has to increase with increasing temperature. Therefore, it is proposed according to a further embodiment of the cable according to the invention that the wall thickness of the electric conductor increase as the length of the installed cable increases in correspondence with the increase of the specific conductor resistance. This preferred embodiment is based on the observation that the temperature of the electric conductor of the cables with interior cooling of the conductor increases with the increasing distance from the point at which the cooling medium is introduced into the cooling channel, so that the equivalent wall thickness also increases in proportion to this increase in temperature, the latter resulting from the increase in the distance from the point of introduction of the cooling medium into the cooling channel. It has been found to be advantageous with this embodiment to assemble the cable from consecutive sections, and to increase the thickness of the electric conductor in incremental steps from one section of the cable to the next consecutive section downstream of the first-mentioned section when viewed in the direction of flow of the cooling medium, so that a cable is obtained which includes a plurality of cable sections in which the thickness of electric conductor increases from one section to the next consecutive one as a function of the distance of the section from the point at which the cooling medium is introduced into the cooling channel and thus as a function of the temperature of the electric conductor.

It has been established that a higher amount of electric energy can be transmitted through the cable according to the invention when the temperature of electric conductor is allowed to exceed the limiting temperature which is determined by the insulating properties of the electric insulation. The advantage obtained by this arrangement is to be seen in the fact that when the temperature of the electric conductor is permitted to increase above such limiting temperature, it is possible to utilize the entire cooling capacity of the cooling medium, such as cooling water, letting the temperature thereof increase just slightly below the boiling temperature of such cooling medium. This can be achieved according to a further currently preferred embodiment of the invention without inflicting any damage to the electric insulation by providing a layer of a material having a high thermal resistance adjacent the outer surface of the electric conductor prior to the application of a coating and of the electric insulation thereto. This layer which is immediately adjacent to the electric conductor serves the purpose of reducing the amount of heat penetrating therethrough so that the temperature at the outer surface of such layer is reduced to a temperature slightly below what the material of the electric insulation can withstand. According to a third embodiment of the invention, it is also advantageous to provide the cable jacket with a similar layer of a material with high thermal resistance so that, while the bulk of the heat which is generated in the electric conductor by passage of the current therethrough is transmitted to the cooling medium and conducted thereby out of the conductor and out of the cable, the remaining heat which is allowed to penetrate through the electric insulation and to reach the cable jacket is mainly conducted through the jacket while only a small portion thereof will be permitted to penetrate through the layer of the material with low thermal conductivity so that it is, for instance, possible to reduce the temperature of the upper or outward surface of a cable which is situated below the surface of the ground below 40° C so that detrimental effects to the environment are avoided.

Since the high-voltage high-energy cable according to the invention comprises an electric conductor having a very large cross-section, the weight per unit of length of such a cable is considerable. Consequently, it would be advantageous to manufacture such a cable from aluminum which has low specific weight. However, one of the disadvantageous properties of aluminum is that it is attacked and caused to corrode by various media, including the cooling water if such is used for cooling the cable. Evidently, it is necessary to make the surface of the aluminum conductor which comes into contact with the cooling medium resistant to the influence of the cooling medium. Thus, it is proposed according to a further embodiment of the cable according to the invention to provide the inner surface of the tubular aluminum conductor which bounds the channel with a protective coating which may be formed by a copper tube located adjacent to such surface, by a tubular member of synthetic plastic material separating the cooling medium from the inner surface of the electric conductor or by providing a metallic oxide layer on such an inner surface. It has also been found to be advantageous, when the tubular member is not needed for conducting the electric current, to make it in its entirety from a synthetic plastic material.

According to a further embodiment of the cable according to the invention, the electric insulation is formed either by oilpaper or by an insulation of synthetic plastic material. Depending on the kind of the electric insulation, various constructions of the cable jacket can be used. So, for instance, when the cable is of the kind in which gaseous medium at superatmospheric pressure is utilized within the jacket, the latter is constituted by a pressure resistant flexible tube; when the cable is of the kind in which pressure of a gaseous medium is applied outwardly, the cable jacket is made of elastic material which separates the pressurized gaseous medium from the electric insulation, and the separate cable strands are pulled into pressure resistant tubes; when the cable is a low-pressure or high-pressure oil cable, then the jacket is provided with a sufficiently large conduit for the oil, since the delivery of the oil to the electric insulation cannot be accomplished through the electric conductor, preferably a corrugated aluminum tube. When the cable is of the type using oil at a static pressure, then the jacket is a pressure resistant tube into which the various strands of the electric conductor are pulled at the location where the cable is being installed, the strands being of a three conductor construction and provided with no separate jackets; when the cable is made of synthetic plastic material, then a flexible corrugated aluminum tube can be utilized for the cable jacket.

When the high-voltage high-energy cable according to the invention is provided with electric insulation of a synthetic plastic material, it is further proposed according to another embodiment of the invention that a layer of a semi-conductive synthetic plastic material is provided immediately adjacent and surrounding the electric conductor, and that the electric insulation of the synthetic plastic material is extruded on such a layer. Since such a layer is in contact only with the exterior surface of the electric conductor, the thermally induced changes in the dimensions of the electric conductor will not result in damage to the synthetic plastic material of the semiconductive layer or to the synthetic plastic material of the electric insulation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
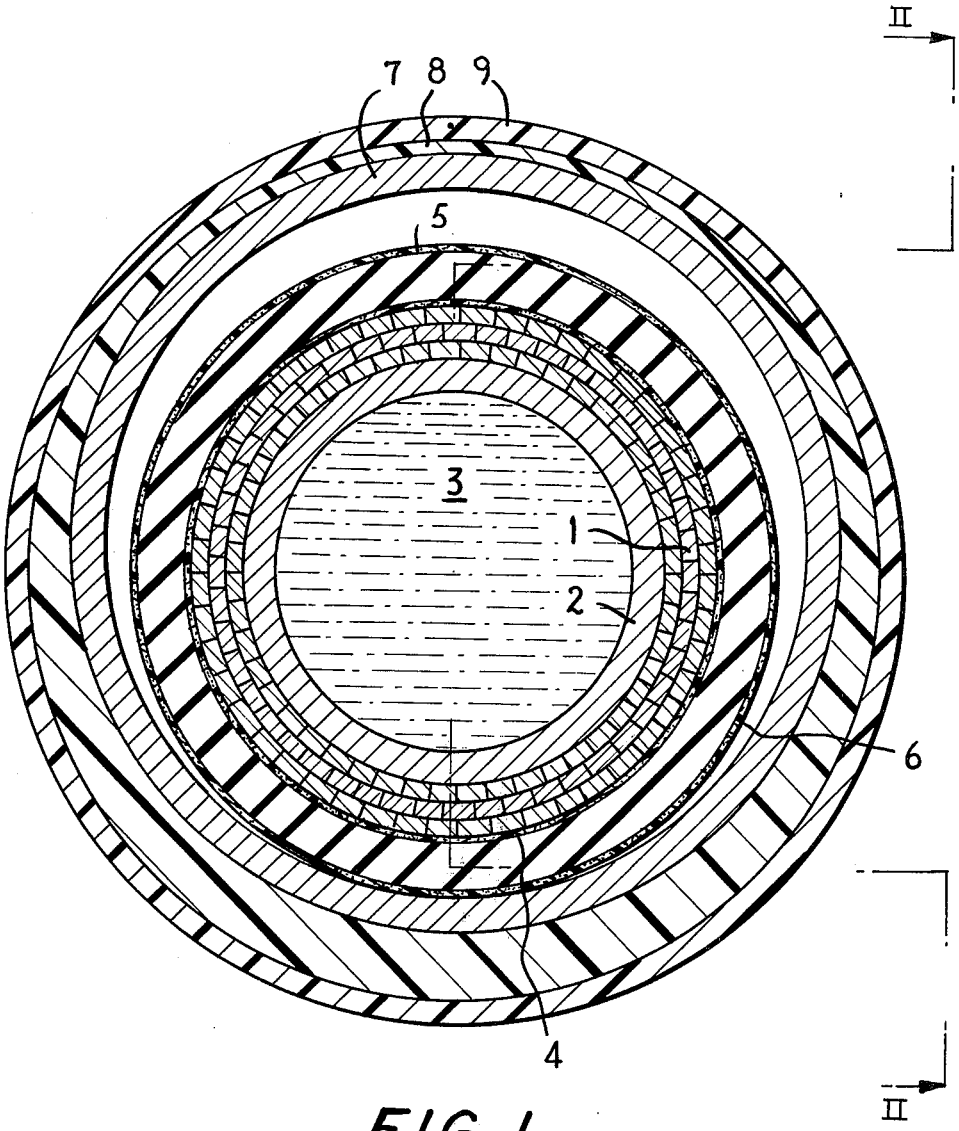
FIG. 1 is a cross-sectional view of a currently preferred embodiment of the cable according to the invention.

The high-voltage high-energy cable according to the invention comprises an electric conductor 1 which is composed, in the currently preferred and illustrated example of the embodiment of the invention, of sealed copper strands which are arranged in three layers. A tubular member 2 made of aluminum is situated inwardly from the electric conductor 1, being surrounded thereby, and defines a hollow channel serving the purpose of conducting a cooling medium 3, such as water. In order to prevent a significant increase in the electric fields, a layer of semiconductive material 4 is provided around the electric conductor 1. An electric insulation 5 surrounds the layer 4. The electric insulation 5 may be, for instance, made of oilpaper or of synthetic plastic material, for instance polyethylene. The tubular member 2, the electric conductor 1, the layer 4, and the electric insulation 5 together constitute a cable core which is surrounded by an electric shielding 6 and is pulled into a corrugated tube 7 which may be made, for instance, of aluminum. The outer surface of the corrugated aluminum tube 7 is provided with a layer 8 of synthetic plastic material and a polyvinylchloride jacket 9 in order to prevent corrosion and/or mechanical damage to the outer surface of the tube 7.

The tubular member 2 which serves the purpose of conducting the cooling medium 3, such as water, has an inner surface which is preferably substantially smooth in order to afforded the channel advantageous flow characteristic. Such advantageous characteristic may be obtained by providing the inner surface with certain corrugations, but it also can be achieved by providing the inner surface of the tubular member 2 with an additional tube which is pulled into the tubular member 2 and is located adjacent to the inner surface thereof, separating the same from the cooling medium. The tubular member 2 preferably has a relatively large inner diameter and, when the layers which surround the tubular member 2 are incapable of withstanding the pressure of the cooling medium, the tubular member 2 should itself be sufficiently rigid to withstand such pressure. Additional requirements for the tubular member 2 are that they have high thermal conductivity, that the thermal resistance of the tubular member 2 be minute when compared to the thermal resistance of the various components or layers surrounding the electric conductor 1 and also when compared with the thermal resistance of the ground in case that the cable is to be situated below the surface thereof. With respect to the construction and the arrangement of the electric conductor 1, it is to be said that it preferably has a large conductive cross-section so that it permits transmission of highest possible transmission currents therethrough. Furthermore, the electric conductor 1 is preferably located immediately adjacent to the tubular member 2 which conducts the cooling medium 3 so as to facilitate thermal heat conduction into and through the tubular member 2 and into the cooling medium 3, and it also is of a very compact construction with a high degree of space filling so as to render possible keeping the outer diameter of the electric conductor 1 and the overall dimensions of the cable to a minimum. In addition thereto, the electric conductor 1 preferably has a possibly smooth outer surface and advantageous electrical properties, particularly low losses due to alternating current loss effects, such as skin effect. Some of the additional desirable properties of the electric conductor 1 are that it may per se constitute a pressure protection of the tubular member 2 against an outward pressure, while remaining flexible without a need for application of excessive flexing forces thereto, while the cross-sectional dimensions of the electric conductor 1 remain virtually unchanged during such flexing of the cable.

The layer 4 may be composed of several layers of soot paper in case that the electric insulation 5 is an oil saturated paper winding. When the electric insulation 5 is an insulation of synthetic plastic material, then the layer 4 may be formed by an extruded semiconductive layer of synthetic plastic material. When the electric insulation 5 consists of oil saturated paper windings, the electric shielding 6 comprises at least one layer of shielding papers which may also be surrounded by copper bands. When the electric insulation 5 is constituted by an insulation of synthetic plastic material, the electric shielding 6 is formed by a semiconductive layer of the same synthetic plastic material as the material constituting the electric insulation 5, and the electric shielding 6 is extruded immediately upon the electric insulation 5. If so desired, copper bands may be provided at least partially surrounding the electric shielding 6. The corrugated aluminum tube 7 can have either helical or annular corrugations.

Figure 2:
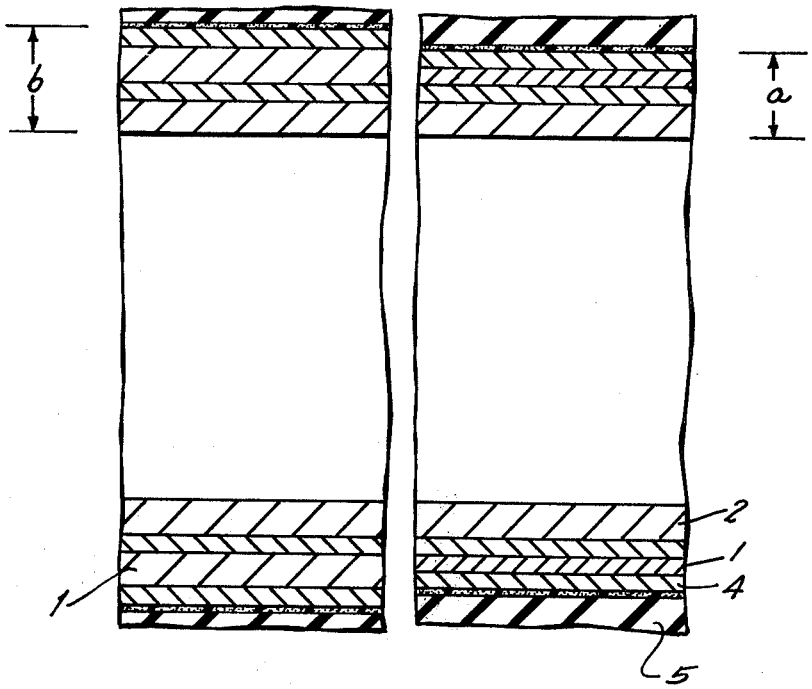
FIG. 2 is a sectional view of two adjacent sections of the cable taken on line II—II of FIG. 1.

FIG. 2 illustrates that the thickness of the electric conductor may increase from *a* to *b*, for reasons which have been discussed previously, from one section of the cable to the next consecutive one.

It will be understood that each of the elements described above, or two or more together, may also find a useful application in other types of high-voltage high-energy cables differing from the types described above.

While the invention has been illustrated and described as embodied in a high-voltage high-energy cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An internally cooled high-energy cable, comprising a circumferentially complete elongated tubular member provided with at least one cooling channel for the flow of a cooling medium; an electric conductor tightly surrounding said tubular member and having a thickness which increases with increasing length of the cable as a function of the increase in the specific resistance of the conductor; electric insulation means surrounding said electric conductor; and a cable jacket surrounding said electric insulation means and separated by the latter from said electric conductor.

2. A cable as defined in claim 1, wherein said cable comprises a plurality of sections; and wherein said thickness of said electric conductor of one of said sections exceeds said thickness of said electric conductor of an other of said sections.

3. A cable as defined in claim 1, wherein said tubular member is of synthetic plastic material.

4. A cable as defined in claim 1, wherein said tubular member is of copper.

5. A water-cooled high-voltage high-energy cable comprising a core including an elongated corrugated fluid-impermeable tubular member defining a cooling channel for passage of cooling water therethrough, a plurality of elongated conductor elements tightly surrounding said tubular member, and electric insulation surrounding said conductor elements, a part of said core which includes at least said conductor elements being of an electrically conductive material selected from the group consisting of copper and aluminum; and an outer cable jacket surrounding said core.

6. A water-cooled high-voltage high-energy cable comprising a core including an elongated fluid-impermeable first tubular member of aluminum having an internal surface, a second fluid-impermeable tubular member within said first tubular member adjacent to said internal surface, said second tubular member defining a cooling channel for passage of cooling water therethrough and being operative for preventing cooling water in said cooling channel from contacting said internal surface of said first tubular member, a plurality of elongated conductor elements tightly surrounding said first tubular member and being of an electrically conductive material selected from the group consisting of copper and aluminum, and electric insulation surrounding said conductor elements; and an outer cable jacket surrounding said core.

7. A water-cooled high-voltage high-energy cable comprising a core including an elongated fluid-impermeable tubular member of aluminum having an internal surface defining a cooling channel for passage of cooling water therethrough, an oxidized layer on said internal surface, a plurality of elongated conductor elements tightly surrounding said tubular member and being of an electrically conductive material selected from the group consisting of copper and aluminum, and electric insulation surrounding said conductor elements; and an outer cable jacket surrounding said core.

8. A water-cooled high-voltage high-energy cable comprising a core including an elongated fluid-impermeable tubular member having an internal surface defining a cooling channel for passage of cooling water therethrough, a layer of fluid-impermeable corrosion-resistant material at said internal surface and operative for preventing cooling water which passes through said cooling channel from corroding said tubular member, a plurality of elongated conductor elements tightly surrounding said tubular member, and electric insulation surrounding said conductor elements, a part of said core which includes at least said conductor elements being of an electrically conductive material selected from the group consisting of copper and aluminum, said part of said core having an inner diameter of more than 60 mm, a thickness of 15 mm, and a conductive cross section of at least 3200 $mm^2$ when of aluminum, and an inner diameter of more than 70 mm, a thickness of 12.5 mm and a conductive cross section of at least 3000 $mm^2$ when of copper; and an outer cable jacket surrounding said core.

9. A water-cooled high-voltage high-energy cable comprising a core including an elongated fluid-impermeable first tubular member of aluminum having an internal surface, a second fluid-impermeable tubular member within said first tubular member adjacent to said internal surface, said second tubular member defining a cooling channel for passage of cooling water therethrough and being operative for preventing cooling water in said cooling channel from contacting said internal surface of said first tubular member, a plurality of elongated conductor elements tightly surrounding said first tubular member and being of an electrically conductive material selected from the group consisting of copper and aluminum, and electric insulation surrounding said conductor elements; and an outer cable jacket surrounding said core.

* * * * *